United States Patent [19]

Rüegg

[11] 4,109,853

[45] Aug. 29, 1978

[54] CENTRIFUGAL FILTER PRESS

[75] Inventor: Ernst Rüegg, Kusnacht, Switzerland

[73] Assignee: De Dietrich & Cie, S.A., Niederbronn-les-Bains, France

[21] Appl. No.: 790,995

[22] Filed: Apr. 26, 1977

[51] Int. Cl.[2] ..... B04B 1/12; B04B 7/04; B04B 15/06

[52] U.S. Cl. ..... 233/2; 233/46; 210/369

[58] Field of Search ..... 233/1 R, 2, 7, 27, 28, 233/29, 46, 47 R; 210/369, 378, 379, 380 R, 382, 377; 127/19, 56

[56] References Cited

U.S. PATENT DOCUMENTS

| | | | |
|---|---|---|---|
| 2,308,559 | 1/1943 | Winkler | 233/7 X |
| 3,114,655 | 12/1963 | Jiskra | 233/46 X |
| 3,123,557 | 3/1964 | McPhee et al. | 210/382 |
| 3,123,557 | 3/1964 | McPhee et al. | 210/377 X |
| 3,250,391 | 5/1966 | Pause | 210/369 |
| 3,301,708 | 1/1967 | Von Rotel | 233/46 X |
| 3,989,185 | 11/1976 | Mercier | 233/2 |

FOREIGN PATENT DOCUMENTS

| | | | |
|---|---|---|---|
| 1,209,955 | 1/1966 | Fed. Rep. of Germany | 233/2 |
| 156,091 | 9/1956 | Sweden | 233/28 |
| 955,434 | 4/1964 | United Kingdom | 233/28 |

*Primary Examiner*—George H. Krizmanich
*Attorney, Agent, or Firm*—Young & Thompson

[57] ABSTRACT

Centrifugal filter press with axial feed moves the material outwardly to at least one annular peripheral filter, via a plurality of oppositely opening conical surfaces. The net axial thrust in one direction is thus reduced, at the same time that the filter can be positioned desirably far from the bearings and the liquid outlet can have a venturi effect that educts what could otherwise be harmful fumes from the vicinity of the bearings.

3 Claims, 2 Drawing Figures

CENTRIFUGAL FILTER PRESS

Figure 1:
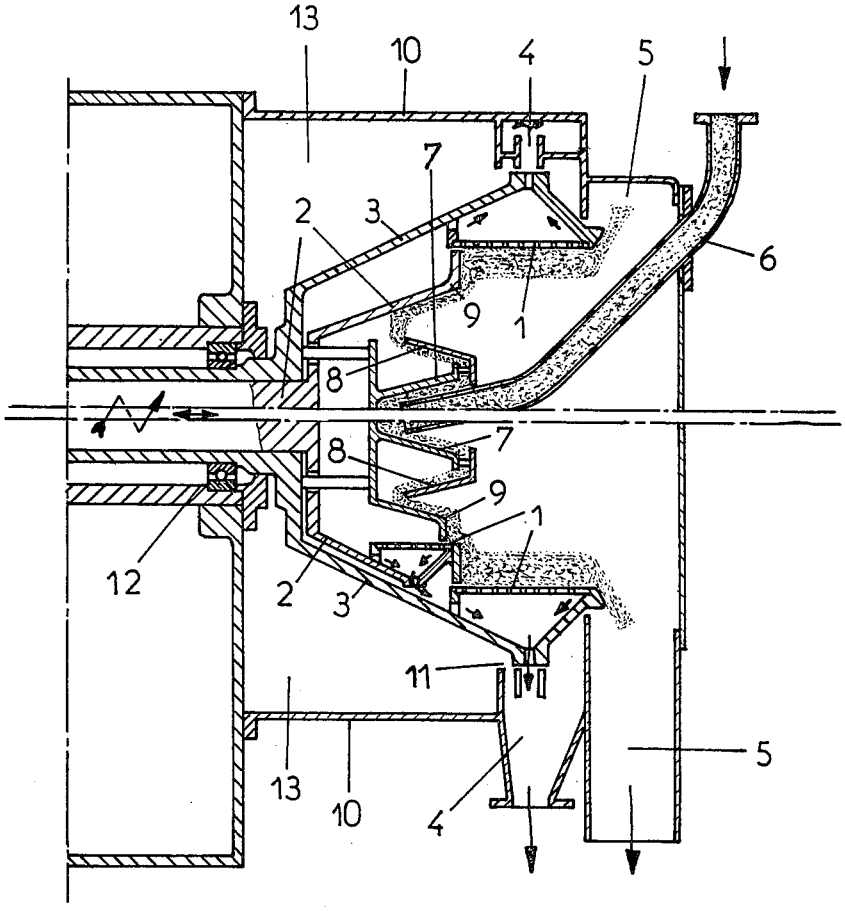

The present invention relates to filtration, and provides a novel centrifugal filter press.

It is known to provide centrifugal filter presses with one or a plurality of stages. These are ordinarily used for separating mixtures of liquids and solids. Such machines ordinarily are designed to handle large tonnages on an hourly or daily basis.

Known centrifugal filter presses generally have a filter basket constituted by one or more cylindrical drums provided with openings distributed about their periphery. One or more filter stages are disposed inside the cylindrical drum and are supported by the same. The drum is housed in a fixed casing which collects the filtrate.

The mixture to be separated is introduced centrally of an imperforate rotary cone that is integral with the filter drum. The large base of the cone is disposed toward the rear of the drum, which cone is necessarily short because it cannot exceed the length of the drum. The minimum value of the conicity of the cone is thus limited. Such a cone serves to accelerate the tangential velocity of the material to be separated, as the material moves radially outwardly along the conical face, in the hope that the speed of rotation of the material to be separated will be the same as that of the filter when they meet. Otherwise, the material will tend to slide relative to the peripheral filter surface of the drum and it will be impossible to establish a filter cake over all that surface with a uniform thickness.

Such centrifugal filter presses as were known heretofore had a number of drawbacks. For one thing, vapors arising from the filtration process tended to condense on or attack the bearings. For example, if a hot suspension is to be filtered, then the steam or vapors from the liquid may cause trouble in this way. Such vapors may condense on the bearings and their solid contents crystallize out on the bearings, which is inconvenient and can even be dangerous in the case of the filtration of materials that react with organic compounds such as are found in lubricating oils and greases.

Accordingly, it is an object of the present invention to provide a centrifugal filter press, in which the tangential speed of the material to be filtered is substantially that of the peripheral filter surface when the two meet.

Another object of the present invention is to provide a centrifugal filter press in which the axial thrust in either direction is reduced.

A still further object of the present invention is the provision of a filter press in which the filtrate is removed at a desirably great distance from the bearings.

Yet another object of the present invention is the provision of a centrifugal filter press in which there is an aspiration of vapors away from the bearings, due to the venturi effect.

Finally, it is an object of the present invention to provide a centrifugal filter press, which will be relatively simple and inexpensive to manufacture, easy to operate, maintain and repair, and rugged and durable in use.

Figure 2:
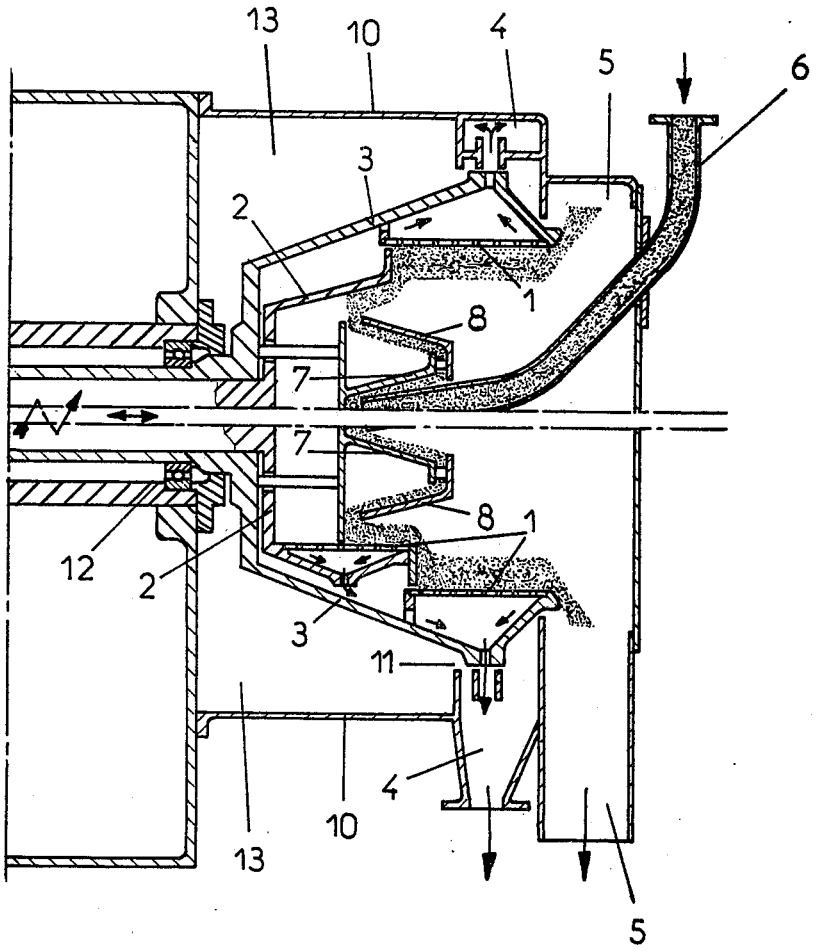

Other objects, features and advantages of the present invention will become apparent from a consideration of the following description, taken in connection with the accompanying drawings, in which:

FIG. 1 shows two half cross-sectional views of a centrifugal filter press according to the present invention, the upper half view showing a single stage device and the lower half view showing a two-stage device; and FIG. 2 is a view similar to FIG. 1, but of a modified form of the invention.

Referring now to the drawings in greater detail, and first to FIG. 1 thereof, there is shown a centrifugal filter press according to the present invention, comprising an imperforate cone 3 on whose interior are fixed one or more filtration stages 1, and a series of cones 7, 8, and 9 which open successively alternately axially, that is, that open in opposite directions each to is neighbor, and that accelerate the material to be separated as the material passes by centrifugal force generally radially outwardly along a zigzag path from cone 7 to cone 8 to cone 9, and thence to the annular cylindrical filter surface 1. A drive shaft 2 mounts the various cones in cantilever relationship for rotation about their common horizontal axis under the influence of a motor or the like (not shown).

Liquid separated from the solids by filtration passes along the wall of cone 3 to an outlet 4; while a collector 5 receives the solid materials. Outlet 4 and collector 5 can be fixed to the fixed casing 10 of the device and have their outlets, shown at the bottom of FIG. 1, adjacent each other.

The mixture of liquid and solid to be separated is introduced axially through a tube 6 and is accelerated along the first cone 7 whose large base opens forwardly, that is, away from the bearings 12 of the device. Then the mixture, still accelerating, passes to a second cone 8 whose conicity is reversed. The mixture then passes to the third cone 9, of reverse conicity, the same as that for cone 7, where further acceleration takes place, until the material is finally received on the rapidly rotating filter 1 at about the same tangential speed as that of the filter 1, so that the material is spread evenly over filter 1 and forms a uniform cake over substantially all of filter 1.

Notice that the axial thrust of cone 8 partially balances that of cones 7 and 9, thereby to reduce the total axial thrust compared to the situation in which but a single cone is responsible for the acceleration of the material.

FIG. 2 is similar to FIG. 1, except that in the case of a plural stage filter as shown at the bottom of FIG. 2, the cone 9 is eliminated and the mixture to be filtered passes directly from cone 8 to the successively radially outwardly spaced stages of filter 1.

The bearings 12 are protected against the vapors that may arise during filtration, because the passageway 11 between the rotating drum and the liquid collector is spaced a substantial distance from even the forward bearing 12. Moreover, thanks to the fact that the liquid passes along conical surfaces such as those provided by cone 3, beyond the filter 1, and then passes through a relatively reduced outlet passageway to collector 4, at the same time that the liquid thus moving radially outwardly at high pressure and velocity is exposed through passageway 11 to the chamber 13 within housing 10, a strong venturi effect is produced which tends to aspirate the vapors from chamber 13 so that they tend to leave with the liquid through outlet 4, thereby reducing the amount of potentially harmful vapors that can reach the bearings 12.

Further protection from the effects of the material filtered, can be provided if the chamber 13 is filled with a neutral gas such as nitrogen. Chamber 13 can also be pressurized thereby to prevent the ingress of harmful vapors. Also, chamber 13 can be sterilized with live steam at low pressure.

From a consideration of the foregoing disclosure, therefore, it will be evident that all of the initially recited objects of the present invention have been achieved.

Although the present invention has been described and illustrated in connection with preferred embodiments, it is to be understood that modifications and variations may be resorted to without departing from the spirit of the invention, as those skilled in this art will readily understand. Such modifications and variations are considered to be within the purview and scope of the present invention as defined by the appended claims.

What is claimed is:

1. In a pusher-type centrifuge comprising a rotary filter drum, means for rotating said drum about its axis, means for feeding material to be filtered centrally of said drum, said drum having a cone along which said material moves radially outwardly and a cylindrical filter coaxial with the drum that subsequently receives said material and separates solids in said material from liquids in said material, the liquids passing radially outwardly through the filter and the solids leaving the filter axially endwise; the improvement in which there are a plurality of said cones concentric with each other and opening in alternately opposite axial directions along the path of said material between said feeding means and said filter, the radially outermost of said cones feeding said material directly to said filter, means to separately remove liquid and solids from adjacent the periphery of said drum, a shaft on which said drum is mounted for rotation, bearings supporting said shaft for rotation, and a fixed casing surrounding and enclosing said drum and bearings, said removing means for liquid filtrate comprising venturi means for educting vapor from within said casing but outside said drum thereby to remove vapor from the vicinity of said bearings.

2. A centrifuge as claimed in claim 1, said removing means comprising at least one conical surface that overlies substantially the entire axial extent of said filter to direct said filtrate radially outwardly toward said liquid removing means.

3. A centrifuge as claimed in claim 1, in which said radially outermost cone directs the material with an axial component of motion in the same direction as the direction in which the solids leave the filter axial endwise.

* * * * *